US012382994B2

(12) United States Patent
Dai et al.

(10) Patent No.: US 12,382,994 B2
(45) Date of Patent: Aug. 12, 2025

(54) HEAT-NOT-BURN TOBACCO DEVICE

(71) Applicant: SHENZHEN FIRST UNION TECHNOLOGY CO., LTD., Shenzhen (CN)

(72) Inventors: Chenpan Dai, Shenzhen (CN); Ruilong Hu, Shenzhen (CN); Zhongli Xu, Shenzhen (CN); Yonghai Li, Shenzhen (CN)

(73) Assignee: SHENZHEN FIRST UNION TECHNOLOGY CO., LTD., Shenzhen Guangdong Province (CN)

( * ) Notice: Subject to any disclaimer, the term of this patent is extended or adjusted under 35 U.S.C. 154(b) by 363 days.

(21) Appl. No.: 17/758,884

(22) PCT Filed: Jan. 15, 2021

(86) PCT No.: PCT/CN2021/072135
§ 371 (c)(1),
(2) Date: Jul. 15, 2022

(87) PCT Pub. No.: WO2021/143836
PCT Pub. Date: Jul. 22, 2021

(65) Prior Publication Data

US 2023/0030451 A1 Feb. 2, 2023

(30) Foreign Application Priority Data

Jan. 17, 2020 (CN) ..... 202020114846.9

(51) Int. Cl.
*A24F 40/46* (2020.01)
*A24F 40/10* (2020.01)

(52) U.S. Cl.
CPC ..... *A24F 40/46* (2020.01); *A24F 40/10* (2020.01)

(58) Field of Classification Search
None
See application file for complete search history.

(56) References Cited

U.S. PATENT DOCUMENTS 8,783,265 B2 7/2014 Shakouri
2016/0135505 A1* 5/2016 Li ..... H05B 3/44 131/329
2019/0192810 A1 6/2019 Trzecieski

FOREIGN PATENT DOCUMENTS

CN 202980147 U 6/2013
CN 204426708 U 7/2015
(Continued)

OTHER PUBLICATIONS

English machine translation of CN 108887758-A; Chen; 26 pages; Nov. 27, 2018. (Year: 2018).*
(Continued)

*Primary Examiner* — Linda L Gray
(74) *Attorney, Agent, or Firm* — Proi Intellectual Property US

(57) ABSTRACT

A heat-not-burn tobacco device, which is used to heat an aerosol-generating substrate so as to generate an aerosol. The heat-not-burn tobacco device comprises: a housing; a heating assembly, which is provided inside of the housing and comprises a heating chamber that extends along the axial direction and that is used to contain an aerosol-generating substrate; a containing cavity, which is located at one end of the heating assembly and is in communication with the heating chamber; a moving member, which is removably connected on the housing and comprises an insertion box that can be inserted into the containing cavity, at least part of the insertion box being axially aligned with the heating chamber so as to receive residue formed inside
(Continued)

of the heating chamber. The heat-not-burn tobacco device facilitates the cleaning of residue generated by heating an aerosol-generating substrate.

10 Claims, 8 Drawing Sheets

(56) References Cited

FOREIGN PATENT DOCUMENTS

| | | | |
|---|---|---|---|
| CN | 209314975 | U | 8/2019 |
| CN | 110384264 | A | 10/2019 |
| CN | 110574966 | A | 12/2019 |
| CN | 211910554 | U | 11/2020 |
| WO | 2015173105 | A1 | 11/2015 |
| WO | 2019121811 | A1 | 6/2019 |

OTHER PUBLICATIONS

English machine translation of CN 103209606 A; Jul. 17, 2013; Burk; 115 pages; A24D3/006. (Year: 2013).*

* cited by examiner

HEAT-NOT-BURN TOBACCO DEVICE

CROSS REFERENCE TO RELATED APPLICATION(S)

This application claims priority to Chinese Patent Application No. 202020114846.9, entitled "Heat-not-burn tobacco device" and submitted to China National Intellectual Property Administration on Jan. 17, 2020, the entire content of which is incorporated herein by reference.

TECHNICAL FIELD

The embodiment of the present disclosure relates to the technical field of smoking sets, and in particular to a heat-not-burn tobacco device.

BACKGROUND

Low-temperature nonburning electronic cigarette is a smoking set that heats an aerosol-generating substrate such as a cigarette using an electric-heating device to generate an aerosol. The low-temperature nonburning electronic cigarette mainly heats rather than burns the aerosol-generating substrate using an electric-heating device so that the aerosol-generating substrate is heated to emit an aerosol. This kind of heat-not-burn tobacco devices generally is provided with a heating chamber for an aerosol-generating substrate such as a cigarette to insert into; when a cigarette is inserted into the heating chamber, the heat-not-burn tobacco device may heat the cigarette to generate an aerosol for a user to inhale. Generally, the cigarette, after being heated inside the heating chamber, will generate residues such as cigarette ash, a condensate liquid, etc. After the heat-not-burn tobacco device is used for many times, the residues such as cigarette ash, a condensate liquid, etc. will impact the heating effect on the cigarette, resulting in the aerosol generated by heating the cigarette having a poor quality, and reducing the user experience; therefore, it is needed to clean the residues such as cigarette ash, a condensate liquid, etc. inside the heating chamber periodically. At present, the heat-not-burn tobacco device generally needs to be disassembled to clean, or, a chamber is disposed below the heating chamber to contain residues and a removable sealing cover is disposed on the housing of the heat-not-burn tobacco device, one just needs to open the sealing cover to clean the chamber, thereby removing the residues; however, these cleaning methods are cumbersome, and the working efficiency is low.

SUMMARY

The embodiment of the present disclosure aims to provide a heat-not-burn tobacco device which is convenient for cleaning the residue generated by heating an aerosol-generating substrate, so as to resolve the problems in existing technologies that the residue generated by heating an aerosol-generating substrate is cumbersome to clean and the working efficiency is low.

In view of the above, one embodiment of the present disclosure provides a heat-not-burn tobacco device, configured to heat an aerosol-generating substrate so as to generate an aerosol, including:

a housing;

a heating assembly, which is provided inside the housing and includes a heating chamber that extends along an axial direction and that is configured to contain the aerosol-generating substrate;

a containing cavity, which is located at one end of the heating assembly and is in communication with the heating chamber; and a moving member, which is removably connected on the housing and includes an insertion box that can be inserted into the containing cavity, at least part of the insertion box being axially aligned with the heating chamber so as to receive a residue formed inside the heating chamber.

Preferably, the insertion box is hollow inside to form a collection bin, and one side of the collection bin close to the heating chamber is of an opening structure, such that the collection bin is in communication with the heating chamber after the insertion box is inserted into the containing cavity.

Preferably, the moving member is provided with an air inlet part that is in communication with an inside of the insertion box, and the air inlet part is configured to allow external air to enter the inside of the insertion box and flow into the heating chamber via the insertion box.

Preferably, the moving member includes a fixing part connected to the insertion box, and the fixing part is detachably provided on the housing so as to keep the insertion box inside the containing cavity.

Preferably, the housing defines a fixing hole adapted to the fixing part at a position thereon corresponding to the containing cavity, so that the insertion box is inserted into the containing cavity.

Preferably, the housing is provided with a fixing buckling position close to the fixing hole, and the fixing part is provided with an elastic buckle fitting with the fixing buckling position.

Preferably, the elastic buckle includes a U-shaped part; when the fixing part is fixed onto the housing through the fitting between the elastic buckle and the fixing buckling position, the U-shaped part interconnects an inside and an outside of the housing; the air inlet part is an air hole defined on a side wall of the insertion box, and external air, after flowing into the housing via the U-shaped part, may flow into the insertion box via the air hole and flow into the heating chamber via the insertion box.

Preferably, the heat-not-burn tobacco device further includes a fixing sleeve, wherein the fixing sleeve is sleeved on the heating assembly and defines a relief hole at a position thereon corresponding to the containing cavity, the insertion box is inserted into the containing cavity from the relief hole, the housing defines an air inlet clearance interconnecting the outside world and an inside of the fixing sleeve, the air inlet part is an air groove defined on the moving member, the air groove interconnects the fixing sleeve and the inside of the insertion box, and external air may flow into the fixing sleeve from the air inlet clearance and then flow into the insertion box via the air groove and flow into the heating chamber via the insertion box.

Preferably, the heat-not-burn tobacco device further includes a porous adsorption element, wherein the porous adsorption element is provided inside the insertion box and is capable of adsorbing the residue inside the heating chamber generated by heating the aerosol-generating substrate.

Preferably, the heating assembly includes an upper fixing seat, a lower fixing seat and a heating element; the heating element is provided between the lower fixing seat and the upper fixing seat, and the heating element is configured to heat the aerosol-generating substrate contained inside the heating chamber.

Preferably, the heating element includes a hollow tubular base body configured for forming the heating chamber and a radiation heating layer located on an inside wall or outside wall of the base body, the radiation heating layer when electrified generates infrared radiation to heat the aerosol-generating substrate inside the heating chamber.

Preferably, the lower fixing seat includes a main body and an insertion part, the main body is configured to fix the heating element, the insertion part is provided on one side of the main body away from the heating element, the insertion part is hollow and is open at one end thereof to form the containing cavity, and inside the main body is formed a collection hole interconnecting the containing cavity and the heating chamber.

According to the heat-not-burn tobacco device of the present disclosure, one end of the heating assembly inside the housing is provided with the containing cavity that is in communication with the heating chamber, the removable moving member is provided on the housing, and when the moving member is installed on the housing, the insertion box of the moving member may be inserted into the containing cavity to be in communication with the heating chamber, thus when the aerosol-generating substrate such as a cigarette is heated inside the heating chamber to generate residues such as cigarette ash or an e-liquid, these residues may fall into the insertion box; when it is needed to clean the heat-not-burn tobacco device, it is only needed to remove the moving member from the housing and then clean the residues inside the insertion box and finally install the moving member on the housing again, and after that the cleaning of the heat-not-burn tobacco device is completed, the operation is simple and convenient and the working efficiency is high.

BRIEF DESCRIPTION OF THE DRAWINGS

One or more embodiments are illustrated through the image(s) in corresponding drawing(s). These illustrations do not form restrictions to the embodiments. Elements in the drawings with a same reference number are expressed as similar elements, and the images in the drawings do not form proportional restrictions unless otherwise stated.

Figure 1:
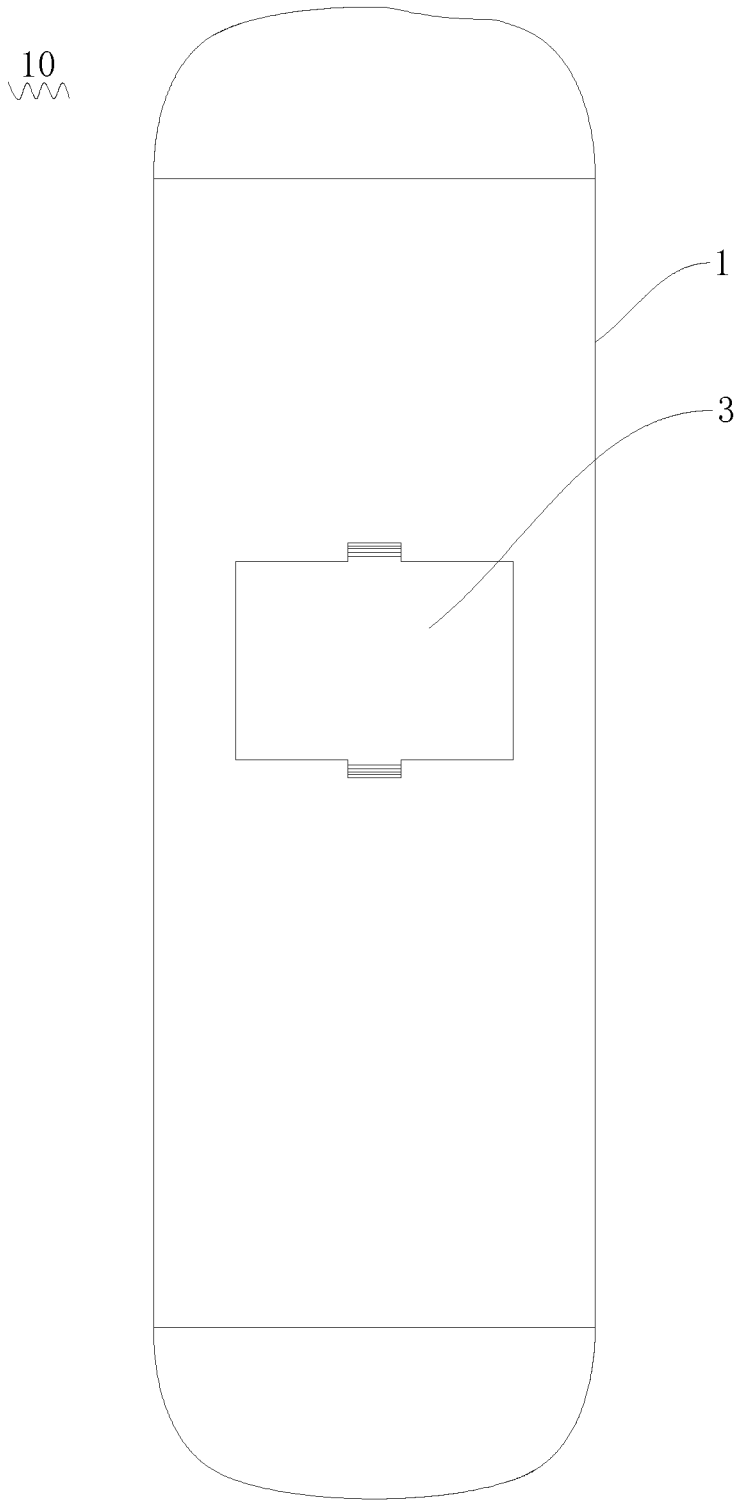
FIG. 1 is a structural diagram of a heat-not-burn tobacco device according to one embodiment of the present disclosure.

In figures, 1 represents a housing, 11 represents a cigarette insertion port, 12 represents an air inlet clearance, 13 represents a fixing hole, 131 represents a fixing buckling position, 2 represents a heating assembly, 21 represents an upper fixing seat, 22 represents a lower fixing seat, 221 represents a main body, 2211 represents a collection hole, 222 represents an insertion part, 2221 represents a containing cavity, 23 represents a heating element, 231 represents a base body, 2311 represents a heating chamber, 232 represents a radiation heating layer, 24 represents a heat insulation tube, 241 represents an inner tube, 242 represents an outer tube, 3 represents a moving member, 31 represents an insertion box, 311 represents a collection bin, 312 represents an air hole, 313 represents an annular groove, 314 represents an air groove, 32 represents a fixing part, 321 represents an elastic buckle, 3211 represents a U-shaped part, 32111 represents a left side plate, 32112 represents a right side plate, 32113 represents a connection plate, 3212 represents a clamping plate, 4 represents a fixing sleeve, 41 represents a relief hole, 42 represents a closed end, 43 represents an open end, 5 represents a porous adsorption element, 6 represents a sealing ring, and 10 represents a heat-not-burn tobacco device.

DETAILED DESCRIPTION

To make the purpose, the technical scheme and the advantages of the embodiments of the present disclosure more apparent and understandable, a clear and complete description is provided to the technical scheme in the embodiments of the present disclosure in conjunction with the drawings in the embodiments of the present disclosure. Obviously, the embodiments described hereinafter are simply part embodiments of the present disclosure, but all the embodiments. It should be understood that the specific embodiments described below are merely to illustrate, but to limit, the present disclosure. All other embodiments obtained by those skilled in the art based on the embodiments in the present disclosure without creative work are intended to be included in the scope of protection of the present disclosure.

It is to be noted that when an element is described as "fixed on" another element, it may be directly on the another element, or there might be one or more intermediate elements between them. When one element is described as "connected to" another element, it may be directly connected to the another element, or there might be one or more intermediate elements between them. Terms "vertical", "horizontal", "left", "right" and similar expressions used in this description are merely for the purse of illustration.

In addition, technical features involved in different embodiments of the present disclosure described below may be combined mutually if no conflict is incurred.

Referring to FIG. 1 to FIG. 4, the heat-not-burn tobacco device 10 according to the embodiment of the present disclosure includes a housing 1, a heating assembly 2 and a moving member 3.

Herein, the housing 1 is hollow inside, the heating assembly 2 is provided inside the housing 1, the heating assembly 2 is provided with a heating chamber 2311 configured to contain an aerosol-generating substrate such as a cigarette, one end of the heating assembly 2 is further provided with a containing cavity 2221 that is in communication with the heating chamber 2311; the moving member 3 is removably connected on the housing 1 and includes an insertion box 31 that can be inserted into the containing cavity 2221; when the insertion box 31 is inserted into the containing cavity 2221, at least part of the insertion box 31 is axially aligned with the heating chamber 2311 so as to receive a residue inside the heating chamber formed by heating the aerosol-generating substrate. In the present embodiment, the housing 1 defines a cigarette insertion port 11 that is in communication with the heating chamber 2311 at a position thereon corresponding to the heating chamber 2311, and the aerosol-generating substrate such as a cigarette may be inserted into the heating chamber 2311 from the cigarette insertion port 11; the residue at least includes cigarette ash, scraps, a condensate liquid, etc., that are generated after the aerosol-generating substrate such as a cigarette is heated.

According to the above heat-not-burn tobacco device 10, one end of the heating assembly 2 inside the housing 1 is provided with the containing cavity 2221 that is in communication with the heating chamber 2311, the removable moving member 3 is provided on the housing 1, and when the moving member 3 is installed on the housing 1, the insertion box 31 of the moving member 3 may be inserted into the containing cavity 2221 to be in communication with the heating chamber 2311, thus when the aerosol-generating substrate such as a cigarette is heated inside the heating chamber 2311 to generate residues such as cigarette ash or an e-liquid, these residues may fall into the insertion box 31; when it is needed to clean the heat-not-burn tobacco device 10, it is only needed to remove the moving member 3 from the housing 1 and then clean the residues inside the insertion box 31 and finally install the moving member 3 on the housing 1 again, and after that the cleaning of the heat-not-burn tobacco device 10 is completed, the operation is simple and convenient and the working efficiency is high.

Figure 9:
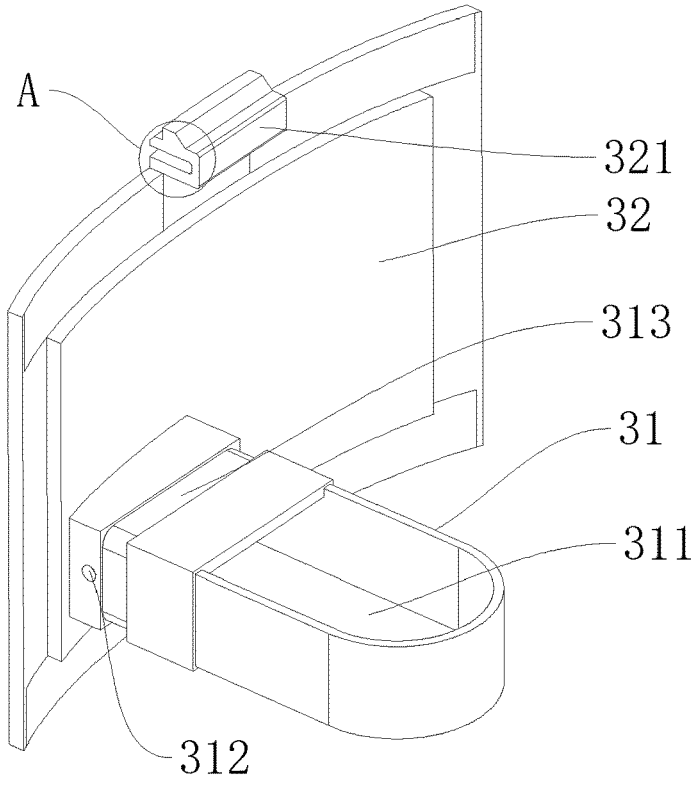
FIG. 9 is a structural diagram of a moving member according to one embodiment of the present disclosure.
Figure 11:
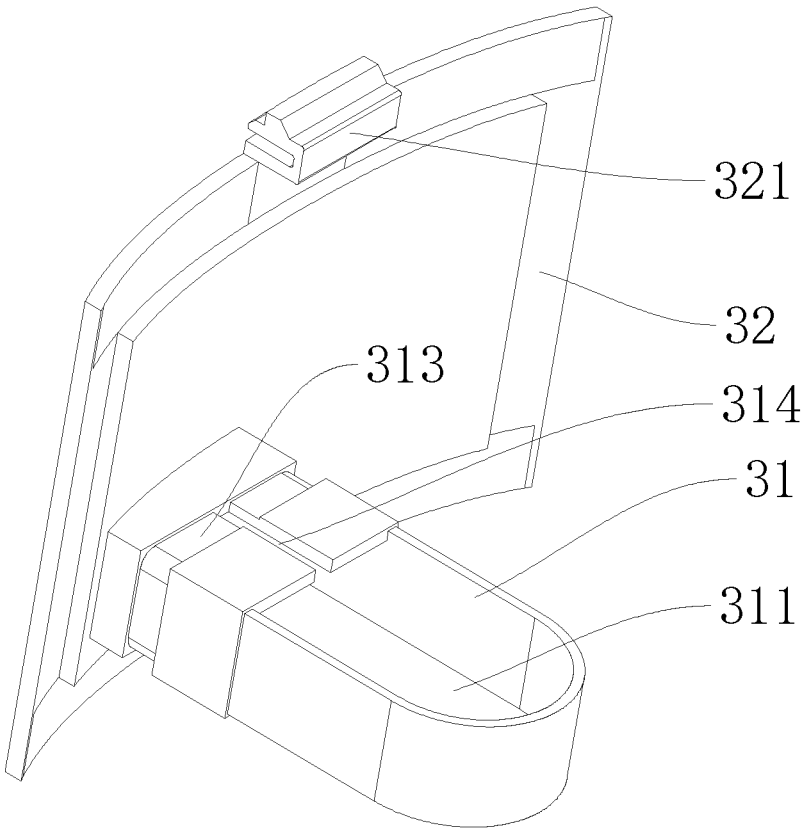
FIG. 11 is a structural diagram of a moving member according to another embodiment of the present disclosure.

In the present embodiment, referring to FIG. 9 and FIG. 11, the insertion box 31 is hollow inside to form a collection bin 311, and one side of the collection bin 311 close to the heating chamber 2311 is of an opening structure, such that the collection bin 311 is in communication with the heating chamber 2311 after the insertion box 31 is inserted into the containing cavity 2221, enabling the residue inside the heating chamber 2311 formed by heating the aerosol-generating substrate to be smoothly received and collected by the collection bin 311 for convenient cleaning.

In one embodiment, referring to FIG. 9 and FIG. 11, the moving member 3 further includes a fixing part 32 connected to the insertion box 31, and the fixing part 32 is detachably connected to the housing 1 so as to insert and keep the insertion box inside the containing cavity 2221, such that the insertion box 31 may stably receive, for a long time, the residue inside the heating chamber 2311 formed by heating the aerosol-generating substrate. In the present embodiment, the insertion box 31 and the fixing part 32 are T shaped, and the fixing part 32 preferably is in the shape of a sheet to facilitate catch and installation. In addition, since the collection bin 311 is provided on the insertion box 31, when the fixing part 32 is detachably installed on the housing 1, the insertion box 31 is inserted into the housing 1 together with the fixing part 32, such that the collection bin 311 is in stable communication with the heating chamber 2311.

As a preferred example of the present embodiment, when the insertion box 31 is inserted into the heating assembly 2, the heating chamber 2311 and the collection bin 311 are disposed up and down, and at least part of the collection bin 311 is axially aligned with the heating chamber 2311 such that the residue inside the heating chamber 2311 generated by heating the aerosol-generating substrate such as a cigarette may fall into the collection bin 311 to be collected under the action of gravity; when to clean the residue inside the collection bin 311, just remove the moving member 3 from the housing 1, the operation is convenient.

Figure 2:
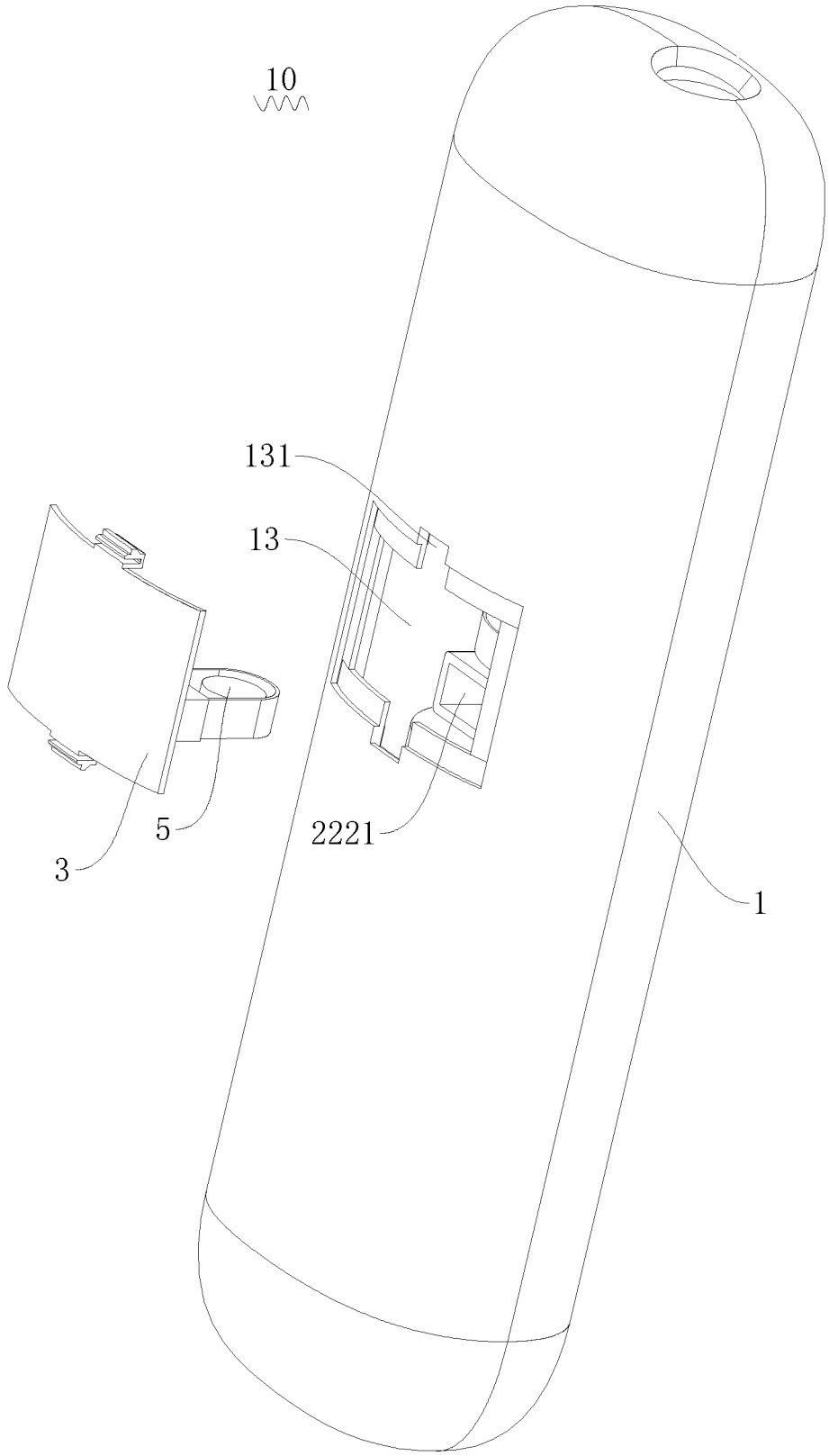
FIG. 2 is a structural diagram of a heat-not-burn tobacco device according to one embodiment of the present disclosure when a moving member is separated from a housing.

In one embodiment, referring to FIG. 2 and FIG. 9, the housing 1 defines a fixing hole 13 adapted to the fixing part 32 at a position thereon corresponding to the containing cavity 2221, so that the insertion box 31 is inserted into the containing cavity 2221. Specifically, in a preferred embodiment, the housing 1 is provided with a fixing buckling position 131 close to the fixing hole 13, and the fixing part 32 is provided with an elastic buckle 321 fitting with the fixing buckling position 131. The fixing part 32 may be detachably fixed onto the fixing hole 13 through the fitting between the elastic buckle 321 and the fixing buckling position 131; the elastic buckle 321 and the fixing buckling position 131 are at least one in number respectively, in the present embodiment there are two elastic buckles 321 and two fixing buckling positions 131, and the two elastic buckles 321 are provided at two opposite sides of the fixing part 32, so that the fixing part 32 may be more stably installed on the fixing hole 13 of the housing 1.

Figure 10:
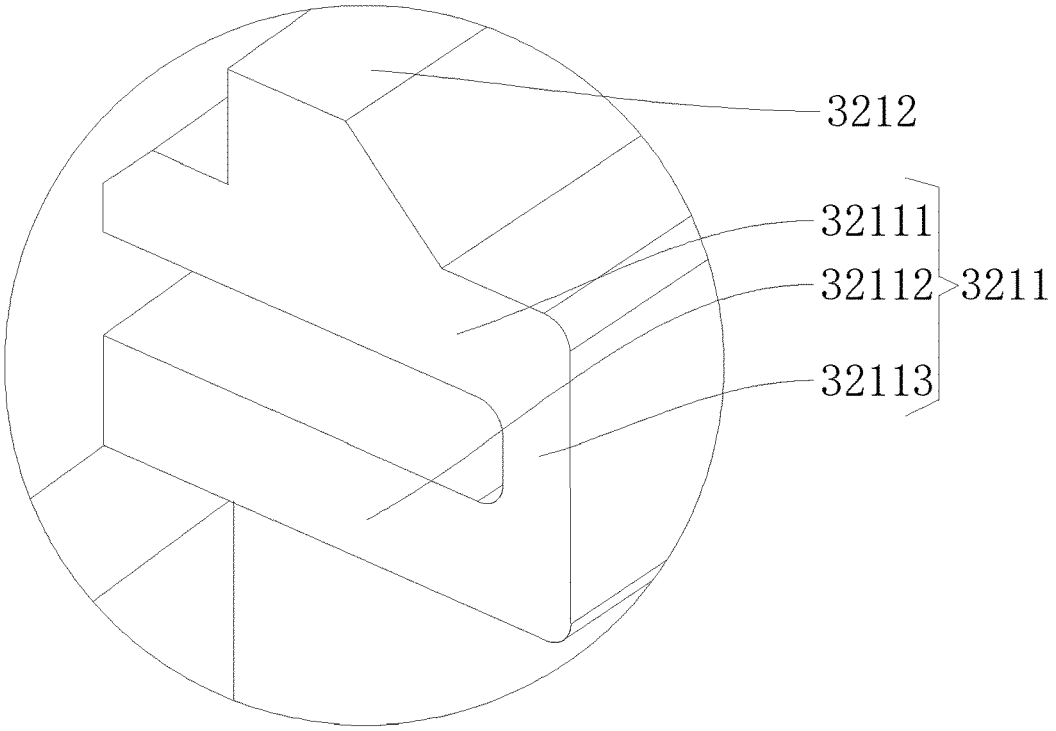
FIG. 10 is an enlarged view of Part A shown in FIG. 9.

In one embodiment, the moving member 3 is provided with an air inlet part that is in communication with an inside of the insertion box 31, and the air inlet part is configured to allow external air to enter the inside of the insertion box 31 and flow into the heating chamber 2311 via the insertion box 31, so as to bring out of the housing 1 the aerosol inside the heating chamber 2311 generated by heating the aerosol-generating substrate, and after that the user can normally inhale the aerosol. Specifically, in a preferred embodiment, referring to FIG. 9 and FIG. 10, the elastic buckle 321 includes a U-shaped part 3211; when the fixing part 32 is fixed onto the housing 1 through the fitting between the elastic buckle 321 and the fixing buckling position 131, the U-shaped part 3211 interconnects an inside and an outside of the housing 1; the air inlet part is an air hole 312 defined on a side wall of the insertion box 31, the air hole 312 penetrates through an inside and an outside of the insertion box 31, and external air may flow into the housing 1 via the U-shaped part 3211, and then flow into the collection bin 311 of the insertion box 311 via the air hole 312 and finally flow into the heating chamber 2311. Specifically, the U-shaped part 3211 includes a left side plate 32111, a right side plate 32112 and a connection plate 32113, wherein the left side plate 32111 and the right side plate 32112 are spaced and disposed at two opposite sides of the connection plate 32113, one end of the right side plate 32112 is connected to the fixing part 32, wherein both of the left side plate 32111 and the right side plate 32112 are extending in the direction close to the inside of the housing 1, one side of the left side plate 32111 away from the right side plate 32112 is provided with a clamping plate 3212 in a protruding manner; when the moving member 3 is installed onto the fixing hole 13 of the housing 1, one end of the left side plate 32111 and one end of the right side plate 32112 are both inserted into the housing 1, the clamping plate 3212 fits with the fixing buckling position 131 to fix the fixing part 32 of the moving member 3 onto the fixing hole 13, by the time since the left side plate 32111 and the right side plate 32112 are spaced, and the left side plate 32111 and the right side plate 32112 are both inserted partially into the housing 1, external air may flow into the housing 1 from the gap between the left side plate 32111 and the right side plate 32112, then flow into the containing cavity 2221 via the air hole 312 on the insertion box 31, flow into the heating chamber 2311 via the collection hole 2211, and finally may bring to the outside world the aerosol inside the heating chamber 2311 generated by heating a cigarette. In addition, since the left side plate 32111 and the right side plate 32112 are spaced and disposed at two opposite sides of the connection plate 32113, when the left side plate 32111 is pushed, the left side plate 32111 may move in the direction close to the right side plate 32112, such that the clamping plate 3212 is separated from the fixing buckling position 131, and after that the moving member 3 may be removed from the housing 1, the operation is very simple. Of course, a hole may be directly opened on the fixing part 32 for external air to flow into the housing 1, then into the collection bin 311 via the air hole 312 on the side wall of the insertion box 31 and finally into the heating chamber 2311; alternatively, a hole that is in communication with the collection bin 311 of the insertion box 31 may be directly defined on the fixing part 32, for external air to enter the collection bin 311 directly from the fixing part 32 and then flow into the heating chamber 2311.

In another preferred embodiment, referring to FIG. 3 to FIG. 4 and FIG. 8 to FIG. 9, the heat-not-burn tobacco device 10 further includes a fixing sleeve 4, wherein the fixing sleeve 4 is sleeved on the heating assembly 2 and defines a relief hole 41 at a position thereon corresponding to the containing cavity 2221, the insertion box 31 is inserted into the lower fixing seat 22 from the relief hole 41, the housing 1 defines an air inlet clearance 12 interconnecting the outside world and an inside of the fixing sleeve 4, the air inlet part is an air groove 314 defined on the moving member 3, the air groove 314 interconnects the fixing sleeve and the collection bin 311 inside the insertion box 31, and external air may flow into the fixing sleeve 4 from the air inlet clearance 12 and then flow into the collection bin 311 of the insertion box 31 via the air groove 314 and finally flow into the heating chamber 2311. Specifically, the air groove 314 is disposed on the insertion box 31, the fixing sleeve 4 is sleeved on the heating assembly 2, the fixing sleeve 4 and the heating assembly 2 are spaced to form an air flowing channel, one end of the fixing sleeve 4 close to the containing cavity is a closed end 42 and the opposite other end is an open end 43; when the heat-not-burn tobacco device 10 employs such an air admission mode, external air first flows to between the fixing sleeve 4 and the heating assembly 2 from the open end 43 of the fixing sleeve 4 via the air inlet clearance 12, then flow into the collection bin 311 via the air groove 314 on the insertion box 31 and finally flow into the heating chamber 2311, so as to discharge the aerosol inside the heating chamber 2311 generated by heating the aerosol-generating substrate to the outside world from the cigarette insertion port 11 of the housing 1. It is worth mentioning that the fixing part 32 may also be fixed onto the fixing hole 13 through magnetic attraction, bolt securing and the like modes. The present embodiment preferably employs a detachable snap-in mode to achieve the securing connection between the fixing part 32 and the housing 1.

Figure 3:
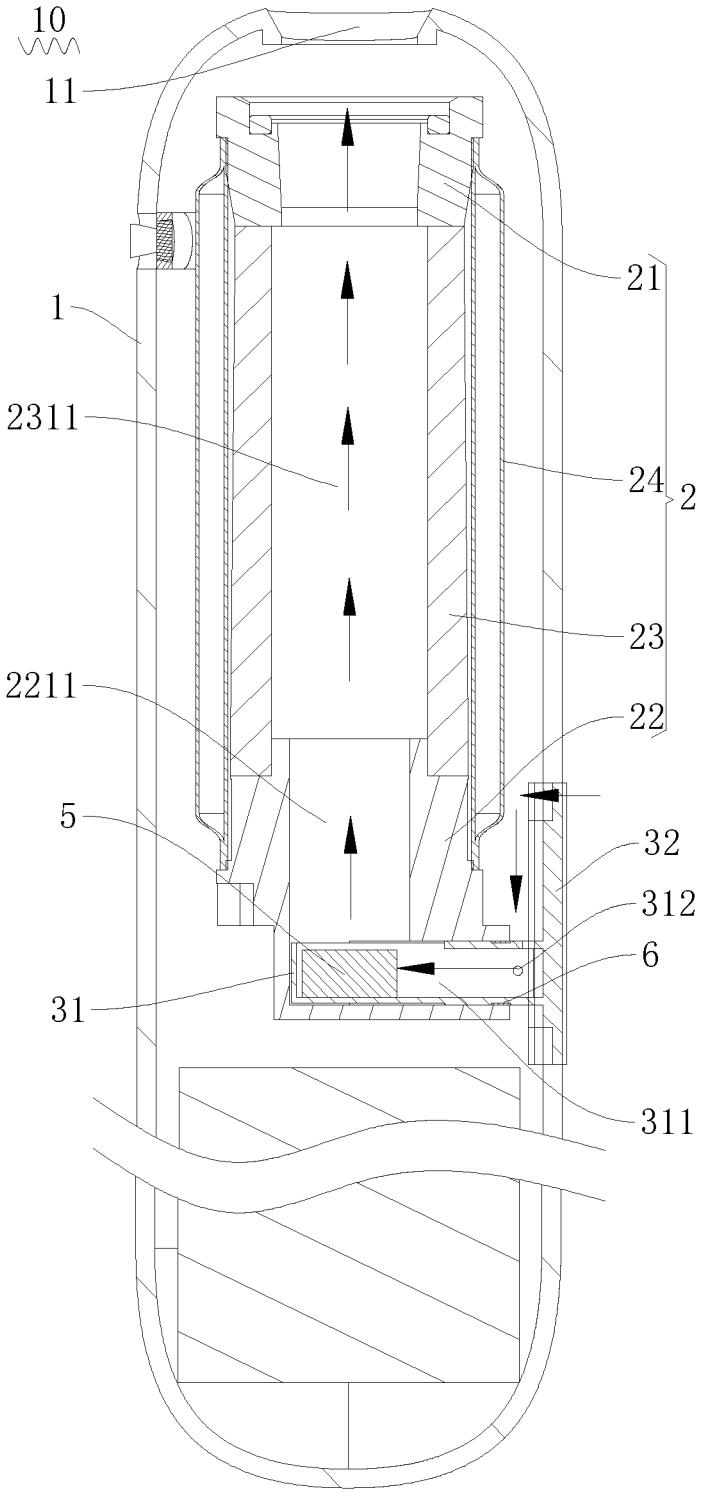
FIG. 3 is a sectional view of a heat-not-burn tobacco device according to one embodiment of the present disclosure.
Figure 4:
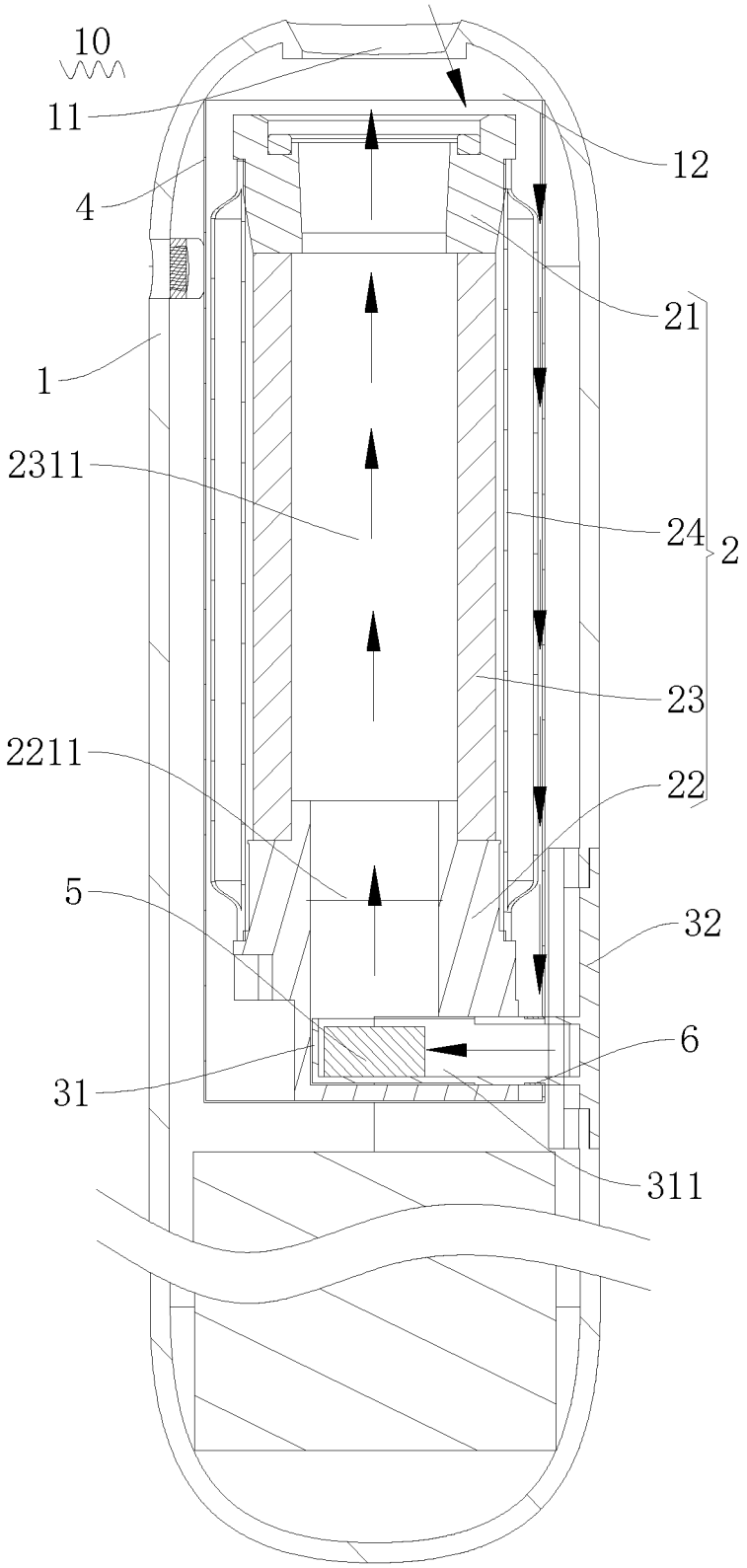
FIG. 4 is a sectional view of a heat-not-burn tobacco device according to another embodiment of the present disclosure.

In one embodiment, referring to FIG. 3 to FIG. 4, the above heat-not-burn tobacco device 10 further includes a porous adsorption element 5, wherein the porous adsorption element 5 is provided inside the collection bin 311 of the insertion box 31 and is capable of adsorbing the residue inside the heating chamber 2311 generated by heating the aerosol-generating substrate. Since the aerosol is easy to condense and form a condensate liquid during the flowing process, the porous adsorption element 5 may effectively absorb the condensate liquid, avoiding the occurrence that the condensate liquid spills to the interior of the housing 1 to cause contamination during the removal process of the moving member 3 after the collection bin 311 is fully filled with the condensate liquid. Preferably, the porous adsorption element 5 may be made of materials with excellent adsorption properties, such as oil absorbent cotton, activated carbon, graphite, etc. By providing the porous adsorption element 5 inside the collection bin 311, the mixture such as cigarette ash and wastes inside the heating chamber 2311 generated by heating the cigarette and the residue such as a condensate liquid generated by condensation of the aerosol may be collected into the containing cavity 2221, keeping the heating chamber 2311 clean, furthermore, when cleaning, it is only needed to take out the porous adsorption element 5 from the collection bin 311, the cleaning operation is convenient.

In one embodiment, referring to FIG. 3 to FIG. 4, the heating assembly 2 includes an upper fixing seat 21, a lower fixing seat 22 and a heating element 23; the heating element 23 is provided between the lower fixing seat 22 and the upper fixing seat 21, and the heating element 23 is configured to heat the aerosol-generating substrate contained inside the heating chamber 2311 to generate an aerosol. In the present embodiment, both of the lower fixing seat 22 and the upper fixing seat 21 may be used for fixing the heating element 23, for example, when the heating element 23 is needle shaped, it may be fixed on the lower fixing seat 22; when the heating element 23 is tube shaped, upper and lower ends of the heating element 23 may be fixed on the lower fixing seat 22 and the upper fixing seat 21 respectively. Specifically, in a preferred embodiment, the heating element 23 includes a hollow tubular base body 231 configured for forming the heating chamber 2311 and a radiation heating layer 232 located on an inside wall or outside wall of the base body 231, the radiation heating layer 232 when electrified may generate infrared radiation to heat the aerosol-generating substrate inside the heating chamber 2311; two opposite ends of the base body 231 are inserted and fixed into the lower fixing seat 22 and the upper fixing seat 21 respectively, the radiation heating layer 232 preferably is a far infrared coating, which when electrified may emit far infrared rays to heat in a radiation manner the aerosol-generating substrate such as a cigarette to generate an aerosol, furthermore, the tubular base body 231 is convenient for inserting the aerosol-generating substrate such as a cigarette; in addition, the tubular base body 231 is convenient to assemble too, during installation, it is only needed to insert two ends of the base body 231 into the lower fixing seat 22 and the upper fixing seat 21 respectively, and then install them in the collection bin 11 of the housing 1. More specifically, the containing cavity 2221 is disposed on the lower fixing seat 22, the containing cavity 2221 is located on one side of the lower fixing seat 22 away from the base body 231, the lower fixing seat 22 further defines a collection hole 2211 thereon, the containing cavity 2221 is in communication with the heating chamber 2311 of the base body 231 through the collection hole 2211, in this way the residue inside the heating chamber 2311 generated by heating the aerosol-generating substrate may flow into the containing cavity 2221 through the collection hole 2211 and fall into the collection bin 311 of the insertion box 31 that is inserted into the containing cavity 2221.

Figure 5:
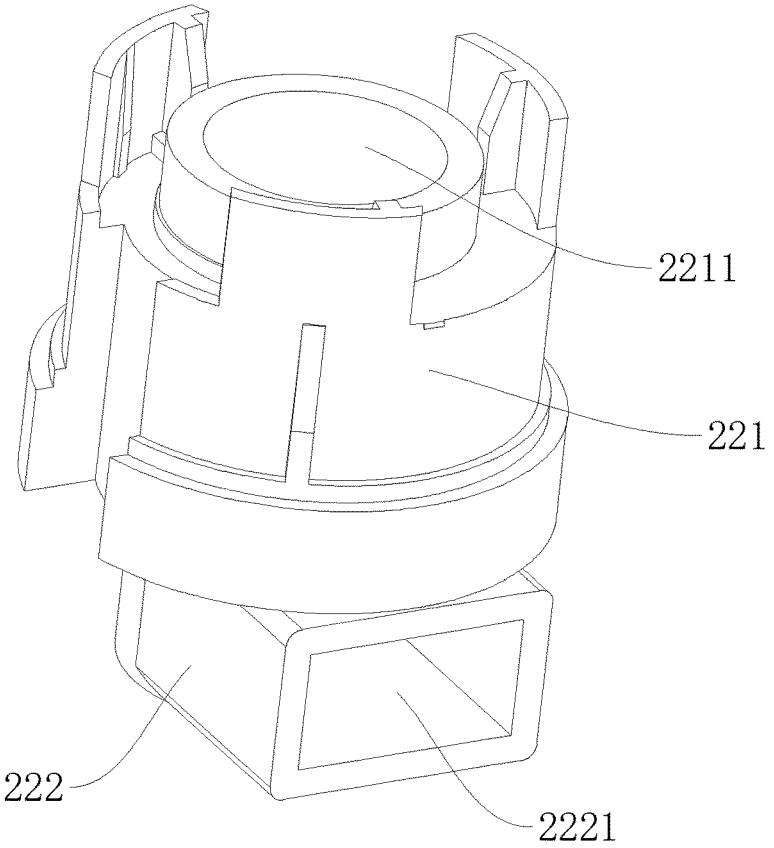
FIG. 5 is a structural diagram of a lower fixing seat according to one embodiment of the present disclosure.
Figure 6:
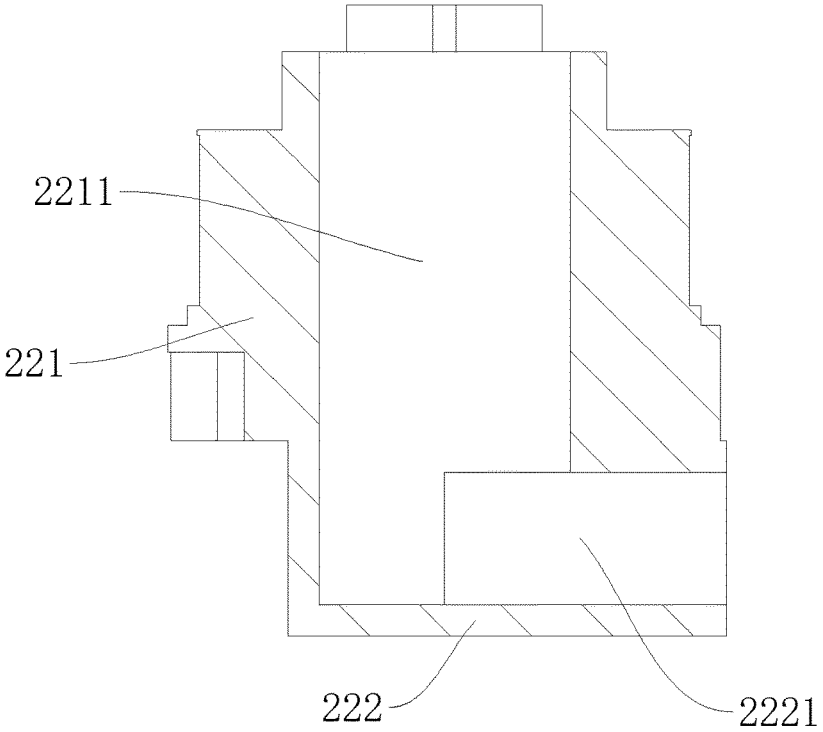
FIG. 6 is a sectional view of a lower fixing seat according to one embodiment of the present disclosure.

Further, referring to FIG. 5 to FIG. 6, the lower fixing seat 22 includes a main body 221 and an insertion part 222, the main body 221 is configured to fix the heating element 23, the insertion part 222 is provided on one side of the main body 221 away from the heating element 23, the containing cavity 2221 is disposed on the insertion part 222, and the collection hole 2211 is formed on the main body 1. Specifically, in the present embodiment, the collection hole 2211 penetrates through one side of the main body 221 close to the heating element 23 and one side away from the heating element 23, the residue inside the heating chamber 2311 generated by heating the aerosol-generating substrate may flow towards the containing cavity 2221 via the collection hole 2211, since the insertion box of the moving member 3 is inserted into the containing cavity 2221, the residue may smoothly flow into the collection bin 311 of the insertion box 31 via the collection hole 2211. In addition, in the present embodiment, the main body 221 and the insertion part 222 are of one integrated structure and are processed into one piece through mold injection. In some other embodiments, the main body 221 and the insertion part 222 may be of a separated structure, the insertion part 222 is inserted and fixed into one side of the main body 221 away from the heating element 23.

Referring to FIG. 3 to FIG. 4, in order to prevent the residue such as cigarette ash, a condensate liquid, etc. leaking from between the containing cavity 2221 and the insertion box 31 of the moving member 3 to contaminate the heat-not-burn tobacco device 10, the insertion box 31 is sleeved with a sealing ring 6, the sealing ring 6 may be made of rubber or silicone rubber, and when the insertion box 31 is inserted into the containing cavity 2221, the sealing ring 6 is disposed on one end of the insertion box 31 close to the fixing part 32 to achieve a good sealing effect; in order to ensure the stable installation of the sealing ring 6 on the insertion box 31, the insertion box 31 defines an annular groove 313, and the sealing ring 6 is sleeved inside the annular groove 313, avoiding the sealing ring 6 generating a displacement relative to the insertion box 31 to impact the sealing effect during the course of the insertion box 31 being inserted into the containing cavity 2221.

Figure 7:
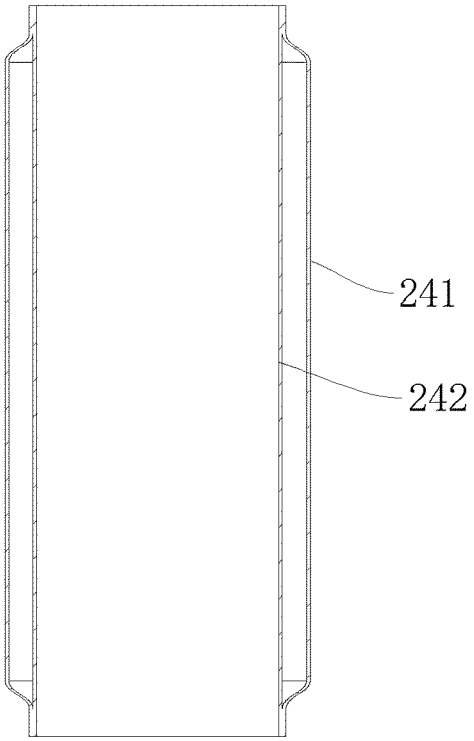
FIG. 7 is a structural diagram of a heating insulation tube according to one embodiment of the present disclosure.
Figure 8:
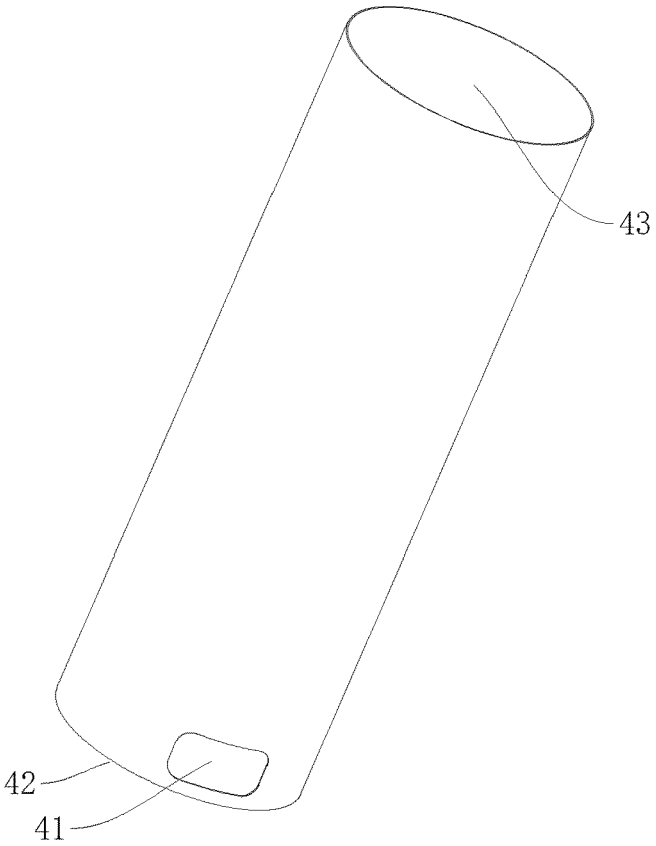
FIG. 8 is a structural diagram of a fixing sleeve according to one embodiment of the present disclosure.

In one embodiment, referring to FIG. 3 to FIG. 4, the heating assembly 2 further includes a heat insulation tube 24, the heat insulation tube 24 is disposed inside the fixing sleeve 4 and is spaced from the fixing sleeve 4 to form an air flowing channel, the heat insulation tube 24 is hollow inside and is sleeved on the heating element 23, the lower fixing seat 22 and the upper fixing seat 21 are both inserted, at least partially, into the heat insulation tube 24. Specifically, referring to FIG. 7, the heat insulation tube 24 includes an inner tube 241, an outer tube 242 and a heat absorption material disposed between the inner tube 241 and the outer tube 242. The inner tube 241 and the outer tube 242 are coaxially disposed, further, upper and lower ends of the inner tube 241 and the outer tube 242 are connected in a sealing manner to form a containing space to contain the heat absorption material. The heat absorption material may be aerogel, and the aerogel may include silicon series, carbon series, sulfur series, metal oxide series and metal series; since 80% of the aerogel is air, the aerogel has a very good insulation effect; the heat absorption material may also be phase-change materials, etc. In some embodiments, when a tubular heating element 23 with a far infrared coating is employed to heat a cigarette, an inside of the inner tube 241 is coated with an infrared ray reflecting material, so as to reflect the far infrared rays emitted by the electrified far infrared coating of the heating element 23 back to the inside of the tubular heating element 23 to heat the cigarette, thereby increasing the effective utilization of the far infrared rays emitted by the far infrared coating and the heating efficiency of the cigarette.

It is to be noted that the description of the present disclosure and the drawings just list preferred embodiments of the present disclosure and are not limited to the embodiments described herein. Further, for the ordinary staff in this field, improvements or variations may be made according to the above description, and these improvements or variations are intended to be included within the scope of protection of the claims appended hereinafter.

What is claimed is:

1. A heat-not-burn tobacco device, configured to heat an aerosol-generating substrate so as to generate an aerosol, comprising:

a housing;

a heating assembly, which is provided inside the housing, wherein the heating assembly comprises a heating chamber that extends along an axial direction and that is configured to contain the aerosol-generating substrate;

a containing cavity, which is located at one end of the heating assembly and in communication with the heating chamber; and a moving member, which is removably connected on the housing and comprises an insertion box that can be inserted into the containing cavity, at least part of the insertion box being axially aligned with the heating chamber so as to receive a residue formed inside the heating chamber;

wherein the heating assembly further comprises an upper fixing seat, a lower fixing seat and a heating element, the heating element provided between the lower fixing seat and the upper fixing seat, and the heating element configured to heat the aerosol-generating substrate contained inside the heating chamber:

wherein the lower fixing seat comprises a main body and an insertion part, the main body is configured to fix the heating element, the insertion part is provided on one side of the main body away from the heating element, the insertion part is hollow and is open at one end thereof to form the containing cavity, and inside the main body is formed a collection hole interconnecting the containing cavity and the heating chamber.

2. The heat-not-burn tobacco device according to claim 1, wherein the insertion box is hollow inside to form a collection bin, and one side of the collection bin facing the heating chamber is of an open structure, such that the collection bin is in communication with the heating chamber after the insertion box is inserted into the containing cavity.

3. The heat-not-burn tobacco device according to claim 1, further comprising a porous adsorption element, wherein the porous adsorption element is provided inside the insertion box and is capable of adsorbing the residue inside the heating chamber generated by heating the aerosol-generating substrate.

4. The heat-not-burn tobacco device according to claim 1, wherein the heating element comprises a hollow tubular base body configured for forming the heating chamber and a radiation heating layer located on an inside wall or outside wall of the base body, the radiation heating layer when electrified generates infrared radiation to heat the aerosol-generating substrate inside the heating chamber.

5. The heat-not-burn tobacco device according to claim 1, wherein the moving member is provided with an air inlet part that is in communication with an inside of the insertion box, and the air inlet part is configured to allow external air to enter the inside of the insertion box and flow into the heating chamber via the insertion box.

6. The heat-not-burn tobacco device according to claim 5, wherein the moving member comprises a fixing part connected to the insertion box, and the fixing part is detachably provided on the housing so as to keep the insertion box inside the containing cavity.

7. The heat-not-burn tobacco device according to claim 6, wherein the housing defines a fixing hole adapted to the fixing part at a position thereon corresponding to the containing cavity, so that the insertion box is inserted into the containing cavity.

8. The heat-not-burn tobacco device according to claim 5, wherein the housing is provided with a fixing buckling position, and the fixing part is provided with an elastic buckle fitting with the fixing buckling position.

9. The heat-not-burn tobacco device according to claim 6, wherein the elastic buckle fitting comprises a U-shaped part;

when the fixing part is fixed onto the housing through the fitting between the elastic buckle fitting and the fixing buckling position, the U-shaped part interconnects an inside and an outside of the housing;

the air inlet part is an air hole defined on a side wall of the insertion box, and external air, after flowing into the housing via the U-shaped part, may flow into the insertion box via the air hole and flow into the heating chamber via the insertion box.

10. The heat-not-burn tobacco device according to claim 5, further comprising a fixing sleeve, wherein the fixing sleeve is sleeved on the heating assembly and defines a relief hole at a position thereon corresponding to the containing cavity, the insertion box is inserted into the containing cavity from the relief hole, the housing defines an air inlet clearance interconnecting an outside and an inside of the fixing sleeve, the air inlet part is an air groove defined on the moving member, the air groove interconnects the fixing sleeve and the inside of the insertion box, and external air may flow into the fixing sleeve from the air inlet clearance and then flow into the insertion box via the air groove and flow into the heating chamber via the insertion box.

* * * * *